US008904715B2

(12) United States Patent
Preiss

(10) Patent No.: US 8,904,715 B2
(45) Date of Patent: Dec. 9, 2014

(54) CONSTRUCTION SYSTEM FOR STRUCTURES

(76) Inventor: Hermann Preiss, Untergruppenbach (DE)

( * ) Notice: Subject to any disclaimer, the term of this patent is extended or adjusted under 35 U.S.C. 154(b) by 0 days.

(21) Appl. No.: 12/734,733

(22) PCT Filed: Dec. 1, 2008

(86) PCT No.: PCT/EP2008/066532

§ 371 (c)(1),
(2), (4) Date: May 19, 2010

(87) PCT Pub. No.: WO2009/068687

PCT Pub. Date: Jun. 4, 2009

(65) Prior Publication Data

US 2010/0251628 A1 Oct. 7, 2010

(30) Foreign Application Priority Data

Nov. 29, 2007 (DE) ..... 10 2007 057 890

(51) Int. Cl.

| | |
|---|---|
| ***E04H 1/00*** | (2006.01) |
| ***E04B 1/348*** | (2006.01) |
| ***E04B 5/14*** | (2006.01) |
| ***E04C 2/296*** | (2006.01) |
| ***E04C 2/34*** | (2006.01) |
| ***E04C 2/38*** | (2006.01) |

(52) U.S. Cl.

CPC ..... *E04B 1/34869* (2013.01); *E04B 1/34838* (2013.01); *E04B 5/14* (2013.01); *E04C 2/296* (2013.01); *E04C 2/34* (2013.01); *E04C 2/386* (2013.01)

USPC ..... 52/79.1; 52/582.1

(58) Field of Classification Search

CPC ..... E04H 1/005; E04B 1/10; E04B 1/26; E04B 7/04; E04B 1/34838; E04B 2001/2457; E04B 5/14; E04B 2/56

USPC ..... 52/79.1, 79.7, 79.9, 236.3, 384, 582.1

See application file for complete search history.

(56) References Cited

U.S. PATENT DOCUMENTS

| | | | | |
|---|---|---|---|---|
| 482,352 | A | 9/1892 | Gibson | |
| 696,996 | A * | 4/1902 | Mott | 52/206 |
| 3,971,172 | A | 7/1976 | Gentil | |
| 4,012,871 | A * | 3/1977 | Netto et al. | 52/79.4 |

(Continued)

FOREIGN PATENT DOCUMENTS

| | | | |
|---|---|---|---|
| AT | 326 322 | B | 12/1975 |
| DE | 26 57 614 | A1 | 7/1977 |

(Continued)

OTHER PUBLICATIONS

Von Georg Kuffner, "High-Tech in puristischer Form," Frankfurter Allgemeinen, Oct. 23, 2007, No. 246, p. T6.

(Continued)

*Primary Examiner* — William Gilbert
*Assistant Examiner* — Gisele Ford
(74) *Attorney, Agent, or Firm* — Collard & Roe, P.C.

(57) ABSTRACT

The invention relates to a modular construction system for tall structures, characterized by prefinished rectangular floor plates or cover plates and pillars or posts which can be disposed and/or attached at the plate corners in each case between one floor plate and one cover plate.

21 Claims, 11 Drawing Sheets

(56) References Cited

U.S. PATENT DOCUMENTS

| | | | | | |
|---|---|---|---|---|---|
| 4,023,315 | A | * | 5/1977 | Stucky | 52/79.13 |
| 4,045,937 | A | * | 9/1977 | Stucky | 52/745.03 |
| 4,124,964 | A | * | 11/1978 | Juriss et al. | 52/745.03 |
| 4,272,930 | A | * | 6/1981 | Foster | 52/79.1 |
| 4,441,286 | A | | 4/1984 | Skvaril | |
| 4,443,992 | A | | 4/1984 | Shechter | |
| 4,485,598 | A | * | 12/1984 | Guardiani | 52/79.1 |
| 4,584,801 | A | * | 4/1986 | Weinberger | 52/64 |
| 5,036,634 | A | * | 8/1991 | Lessard et al. | 52/79.1 |
| 5,354,223 | A | * | 10/1994 | Wawzonek | 446/106 |
| 5,400,845 | A | * | 3/1995 | Choiniere et al. | 144/353 |
| 8,011,156 | B1 | * | 9/2011 | Schwan | 52/653.1 |
| 2002/0166293 | A1 | | 11/2002 | Zeik et al. | |
| 2008/0066422 | A1 | | 3/2008 | Huxel | |

FOREIGN PATENT DOCUMENTS

| | | | |
|---|---|---|---|
| DE | 30 48 360 | A1 | 7/1982 |
| DE | 36 23 917 | | 2/1987 |
| DE | 88 15 831.4 | U1 | 2/1989 |
| DE | 89 01 471.5 | U1 | 8/1989 |
| DE | 92 11 330.3 | U1 | 2/1993 |
| DE | 94 15 786.3 | U1 | 12/1994 |
| DE | 295 09 801 | U1 | 8/1995 |
| DE | 198 19 942 | A1 | 9/1999 |
| DE | 298 08 134 | U1 | 9/1999 |
| DE | 10 2005 009 978 | A1 | 9/2006 |
| FR | 924 328 | | 8/1947 |
| FR | 2 628 462 | | 9/1989 |
| GB | 1 485 028 | A | 9/1977 |
| GB | 1 516 794 | | 7/1978 |
| GB | 2 282 395 | | 4/1995 |
| JP | 11-293844 | | 10/1999 |
| KR | 100694665 | | 3/2007 |
| RU | 2 192 525 | | 11/2002 |
| RU | 49 860 | | 12/2005 |
| SU | 15499 | | 3/1929 |
| SU | 998682 | | 2/1983 |
| SU | 1081307 | | 3/1984 |
| WO | 94/04771 | A1 | 3/1994 |
| WO | WO 95/17560 | | 6/1995 |
| WO | WO 2004/099516 | | 11/2004 |
| WO | WO 2005/088021 | | 9/2005 |
| WO | WO 2006/092262 | | 9/2006 |

OTHER PUBLICATIONS

International Search Report.

Russian Office Action received Feb. 5, 2013 in Russian Application No. 2010119771/03 (028154) with English translation.

Getz, K.-G., "Wood structure atlas," Moscow, Stroyizdat, 1985, pp. 42-43, dr. 3 (6). (Russian Office Action).

German Search Report dated Sep. 3, 2009 in German Application No. 10 2007 057 890.5 with English translation of relevant parts.

* cited by examiner

CONSTRUCTION SYSTEM FOR STRUCTURES

CROSS REFERENCE TO RELATED APPLICATIONS

This application is the National Stage of PCT/EP2008/066532 field on Dec. 1, 2008, which claims priority under 35 U.S.C. §119 of German Application No. 10 2007 057.5 filed on Nov. 29, 2007. the international application under PCT article 21(2 )was not published in English.

BACKGROUND OF THE INVENTION

1 Field of the Invention

The invention relates to a modular construction system for structures.

2 Description of Related Art

A modular construction of structures is known in principle, cf. for example the article "High-Tech in puristic form" on page T6 in the Frankfurter Allgemeinen dated Oct. 23, 2007 (number 246). There, however, the modular construction clearly relates to special solar modules.

SUMMARY OF THE INVETION

By contrast, the object of the invention is to provide a building with a modular three-dimensional and supporting structure. In particular, it is intended to make it possible to be able to produce a house or building in a short time using industrially produced standard parts.

This object is achieved according to the invention in that the modular construction system substantially consists of prefabricated, rectangular floor or ceiling slabs and supports or posts which are arranged or can be inserted at the slab corners between a respective floor and ceiling slab.

By designing and arranging the supports or posts with corresponding loadability in the shear and rotation and tension direction, room-size modules which can be stacked on top of one another can be formed from in each case a floor slab and a ceiling slab and supports arranged between them at the slab corners, with which modules the skeleton structure of a building can be produced in an extremely simple manner, wherein in each case the floor slab or the floor slabs of an upper story lie on the ceiling slab or the ceiling slabs of the story lying below. Wall and/or window and/or door elements can be inserted in any desired manner in principle between the floor and ceiling slabs of a story, with the result that a story can be divided into individual rooms as desired.

Here, the wall elements also perform a co-supporting function, in particular if the wall elements are arranged at the slab edges.

However, a supporting or co-supporting function of the wall elements is not necessary, since, according to a particularly preferred embodiment of the invention, the loadability is ensured by corresponding stability of the floor or ceiling slabs and the posts or supports arranged in between at the slab corners. This also applies when the room modules formed by means of the slabs and supports or posts are stacked on top of one another.

Furthermore, it is provided in a particularly advantageous embodiment of the invention to design the floor and ceiling slabs and also the supports or posts and/or the wall elements as adhesive-free wooden constructions and to provide pins to connect the wooden elements.

As a result, a particularly pleasant pollutant-free room climate can be achieved within the building.

In the case of such a wooden construction, the floor or ceiling slabs can have a beam frame which forms the slab edge and between whose beams forming the frame longitudinal sides a plurality of transverse beams are arranged, with the result that the frame obtains a ladder structure. A wood cladding is provided for the upper and lower side of the frame, wherein the clearance between the upper and lower cladding can be filled with in principle any desired insulating materials, in particular mineral wool. The cladding is preferably cut out at the frame corners, with the result that the supports or posts provided there can be connected directly to frame elements of the respective slab and sufficient free space remains on the side of the frame remote from the respective post or the respective support for exposed elements of dowel arrangements for connecting the frame elements and posts or supports, specifically even when the ceiling slab of a lower story is intended to have the floor slab of the above-lying story arranged thereon.

BRIEF DESCRIPTION OF THE DRAWINGS

Furthermore, with respect to preferred features of the invention, reference is made to the claims and the following explanation of the drawing, by means of which a particularly preferred embodiment of the invention will be described in more detail.

Protection is claimed not only for expressly represented or claimed combinations of features but also for any combinations in principle of the illustrated individual features.

In the drawing:

Figure 1:
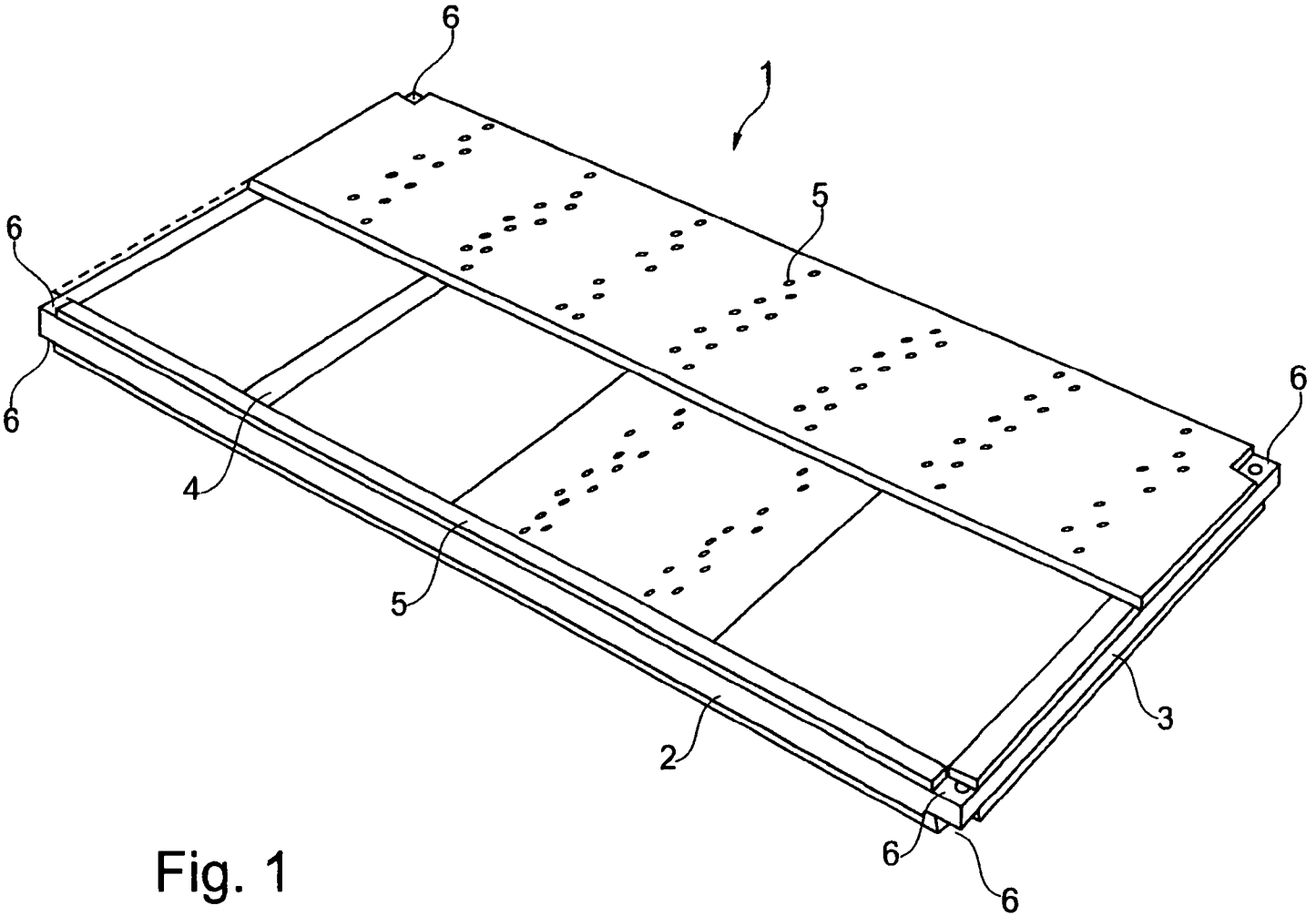
Figure 2:
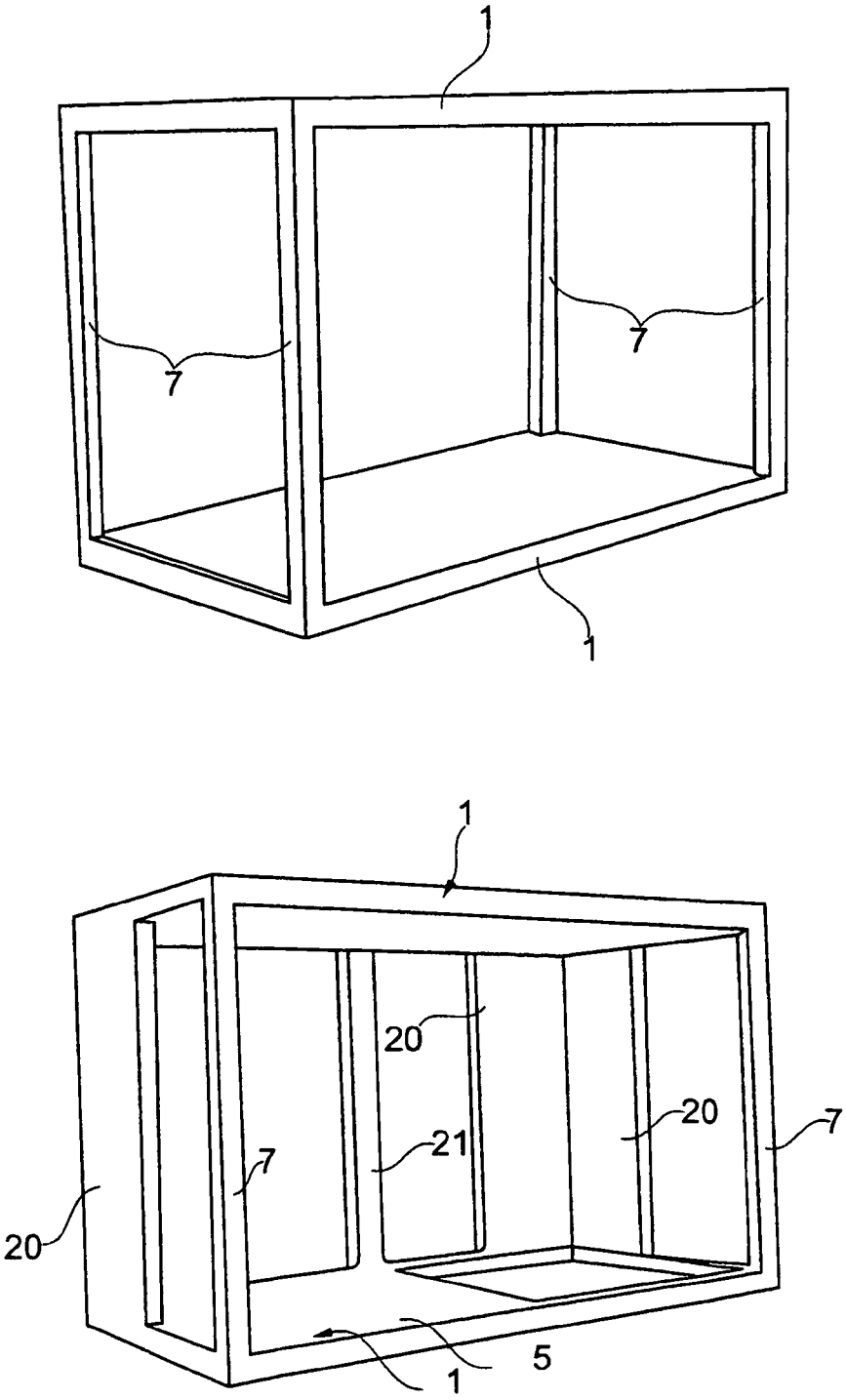
Figure 3:
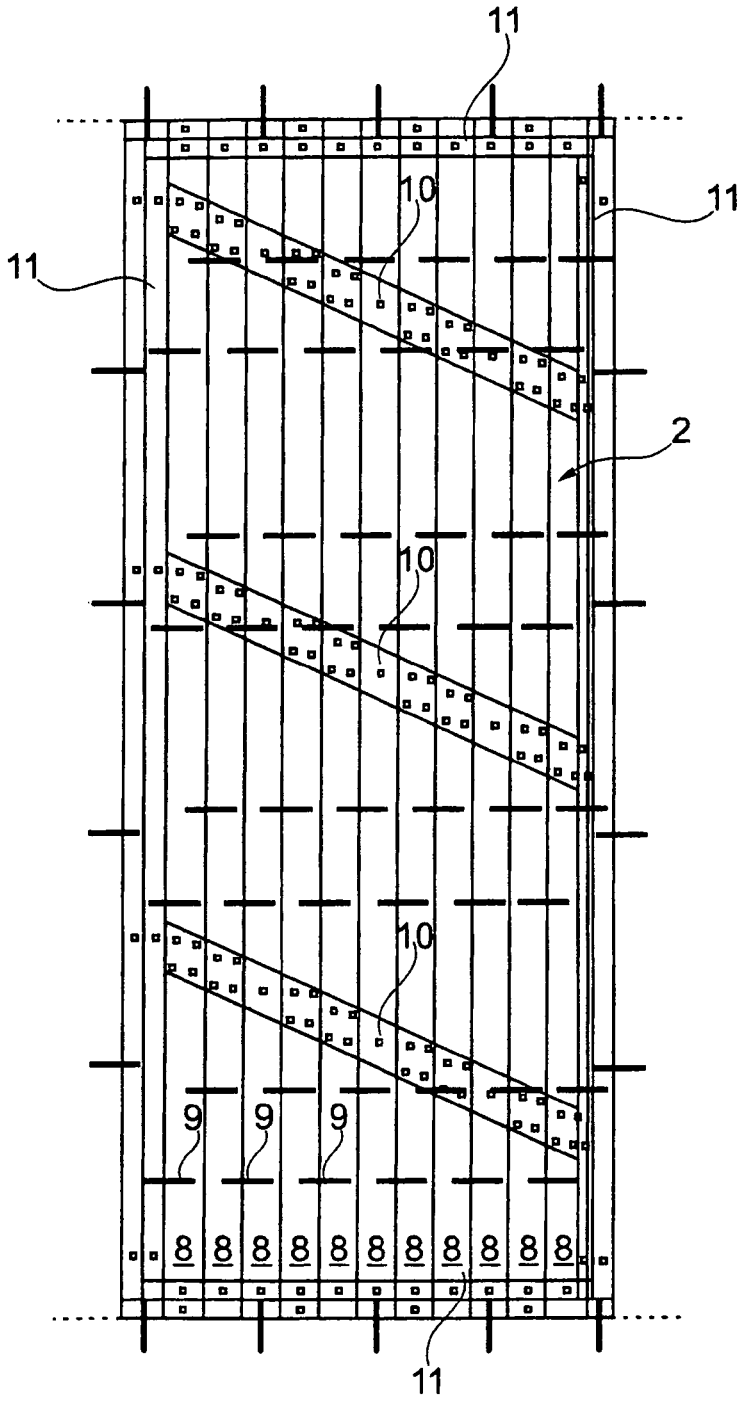
Figure 4:
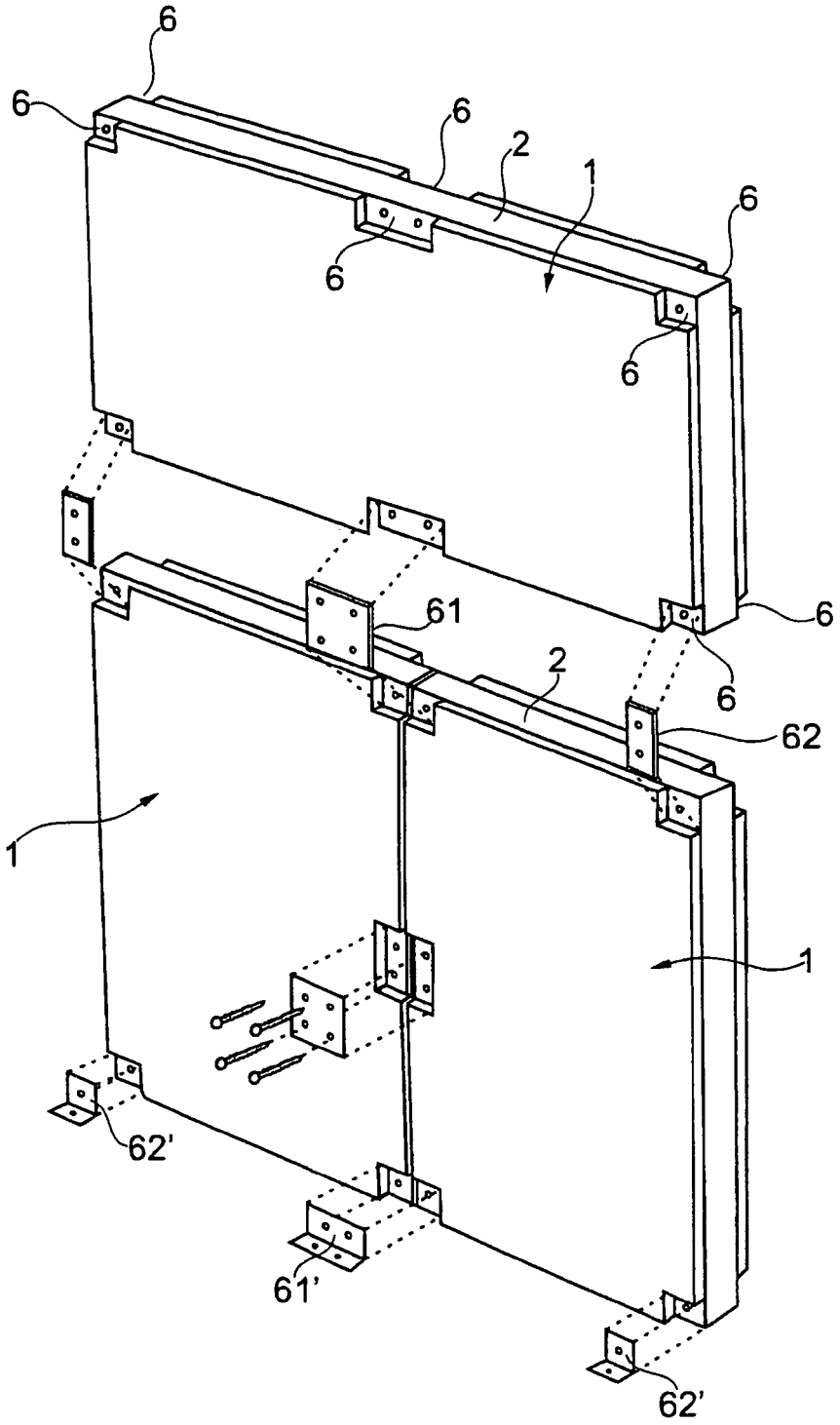
Figure 5:
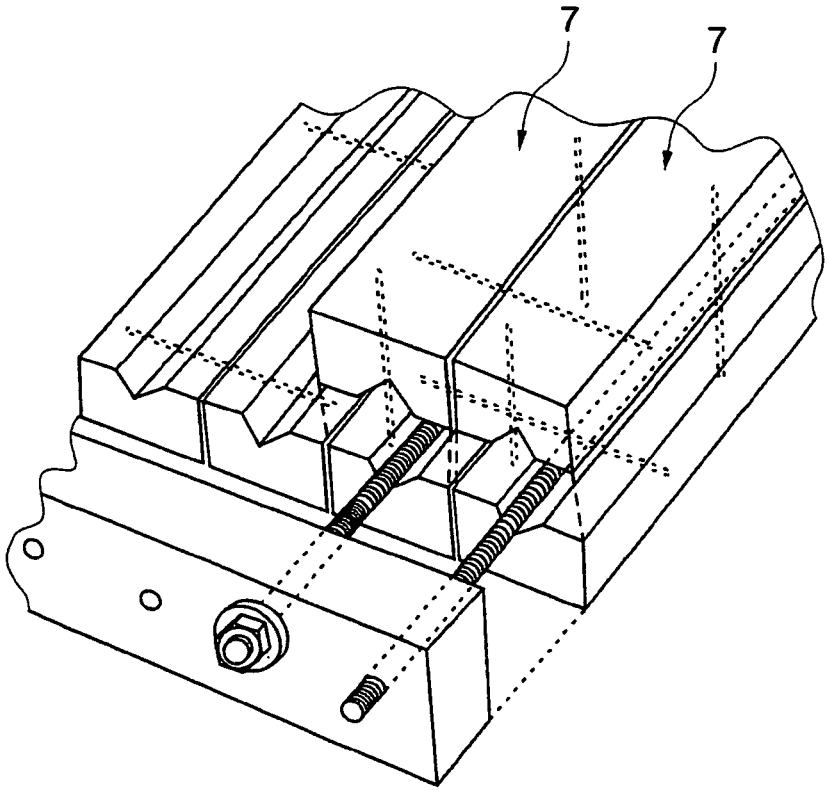
Figure 6:
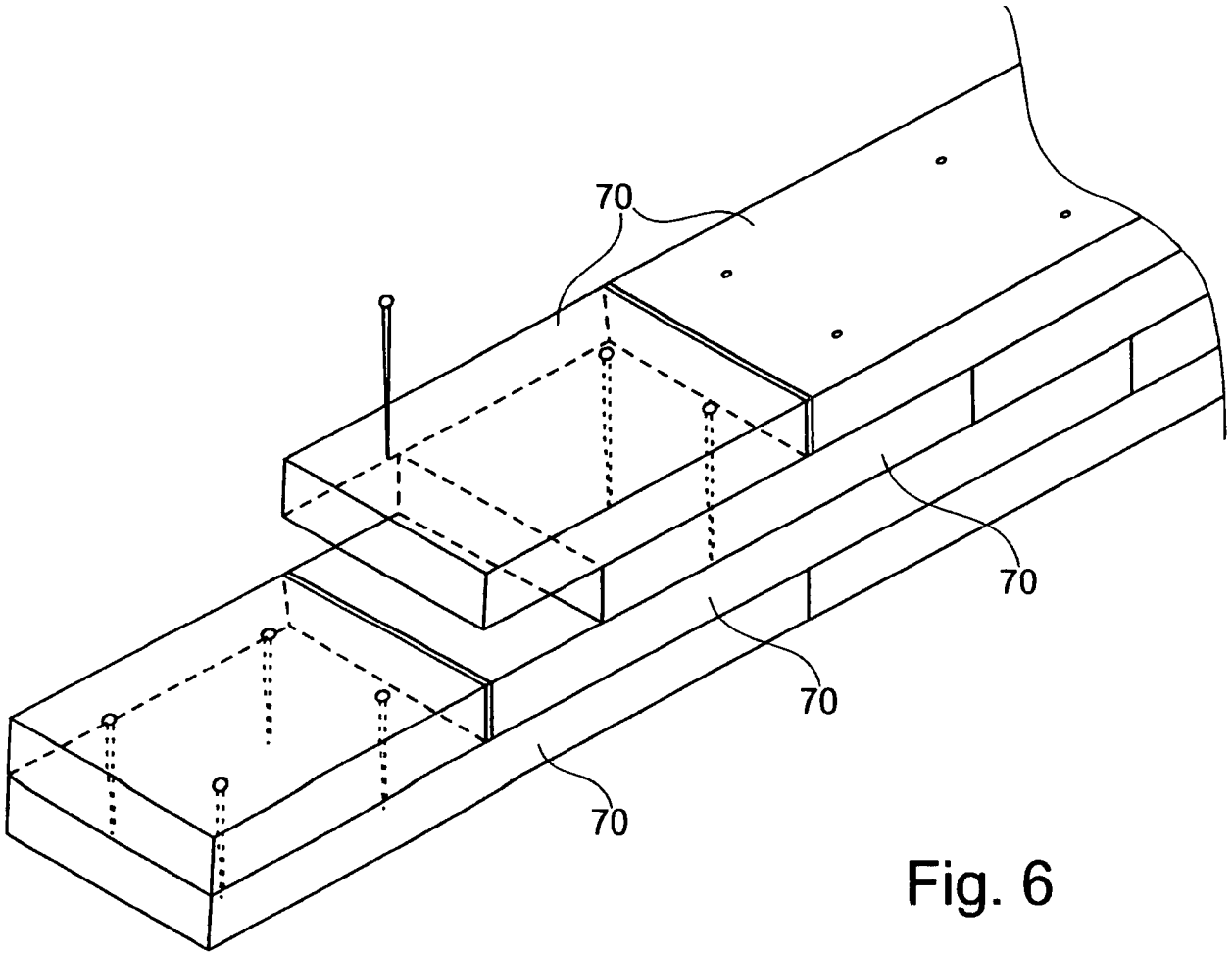
Figure 7:
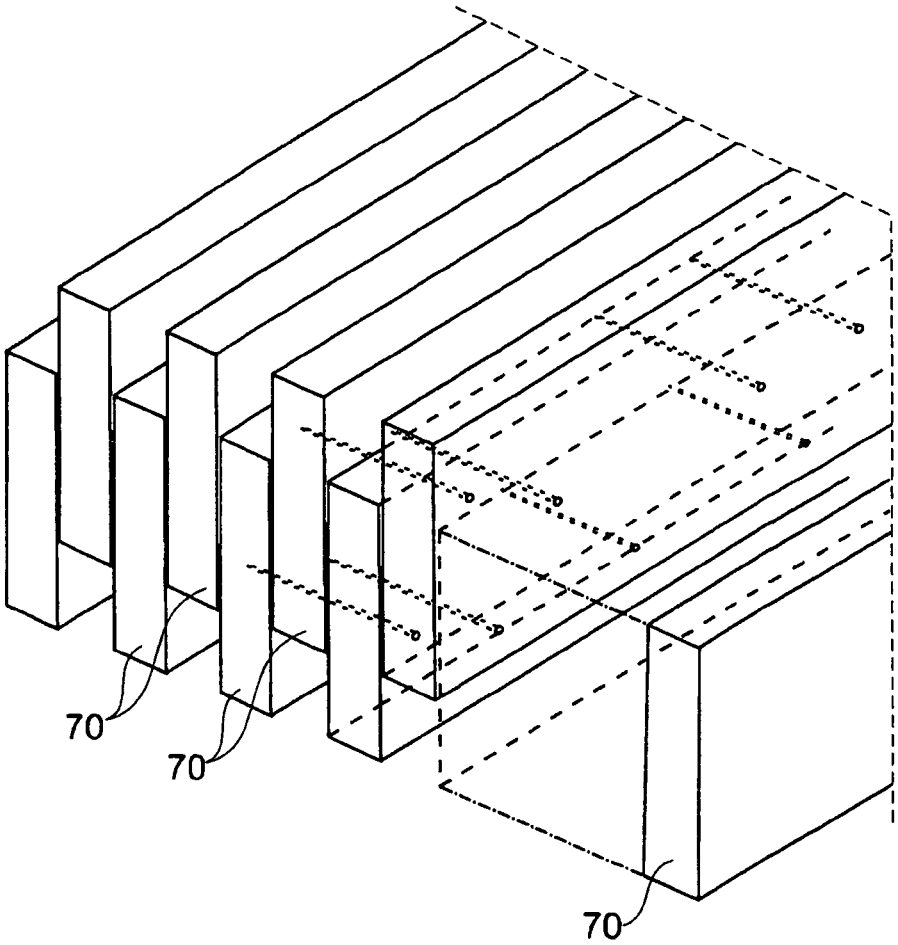
Figure 8:
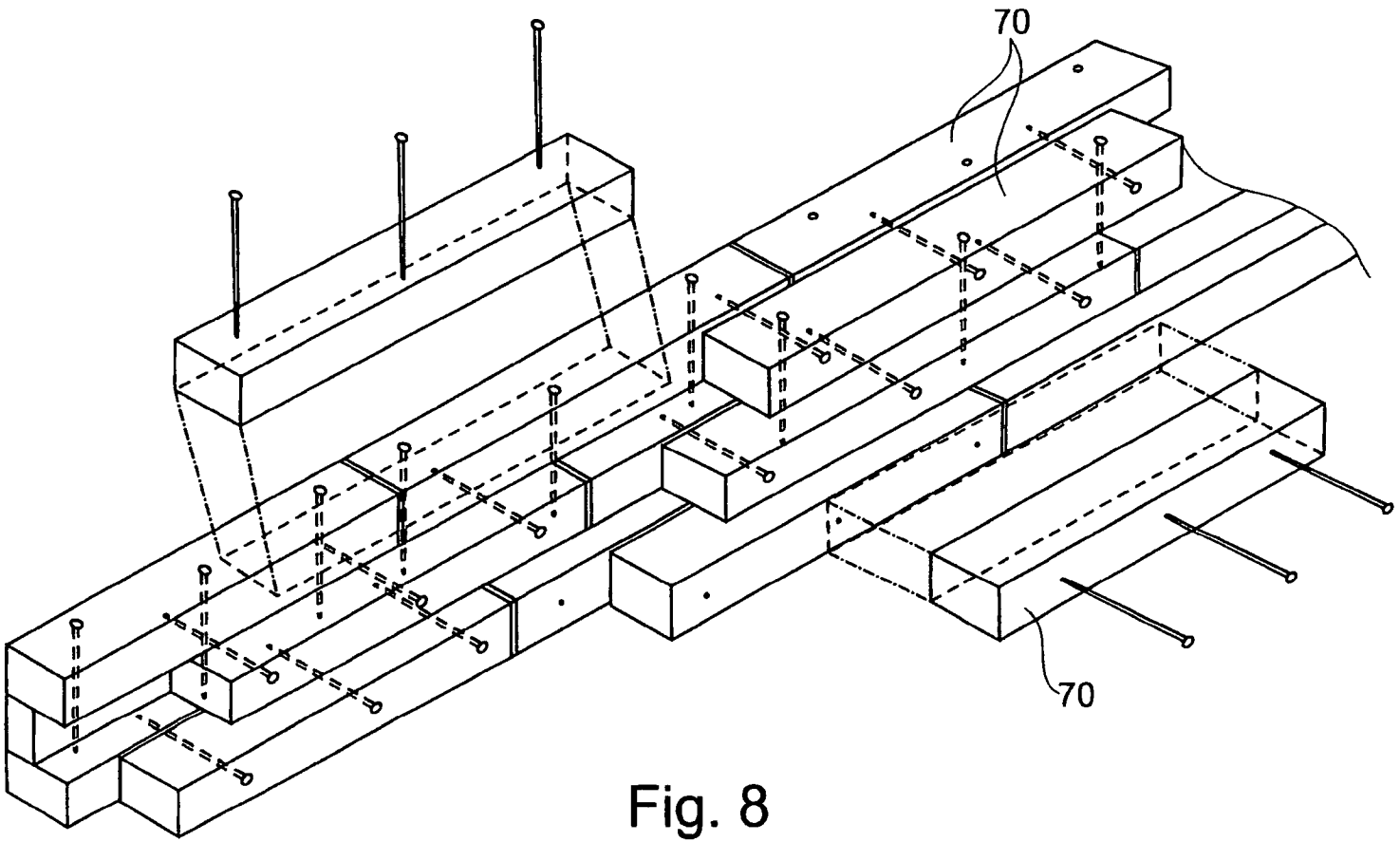
Figure 9:
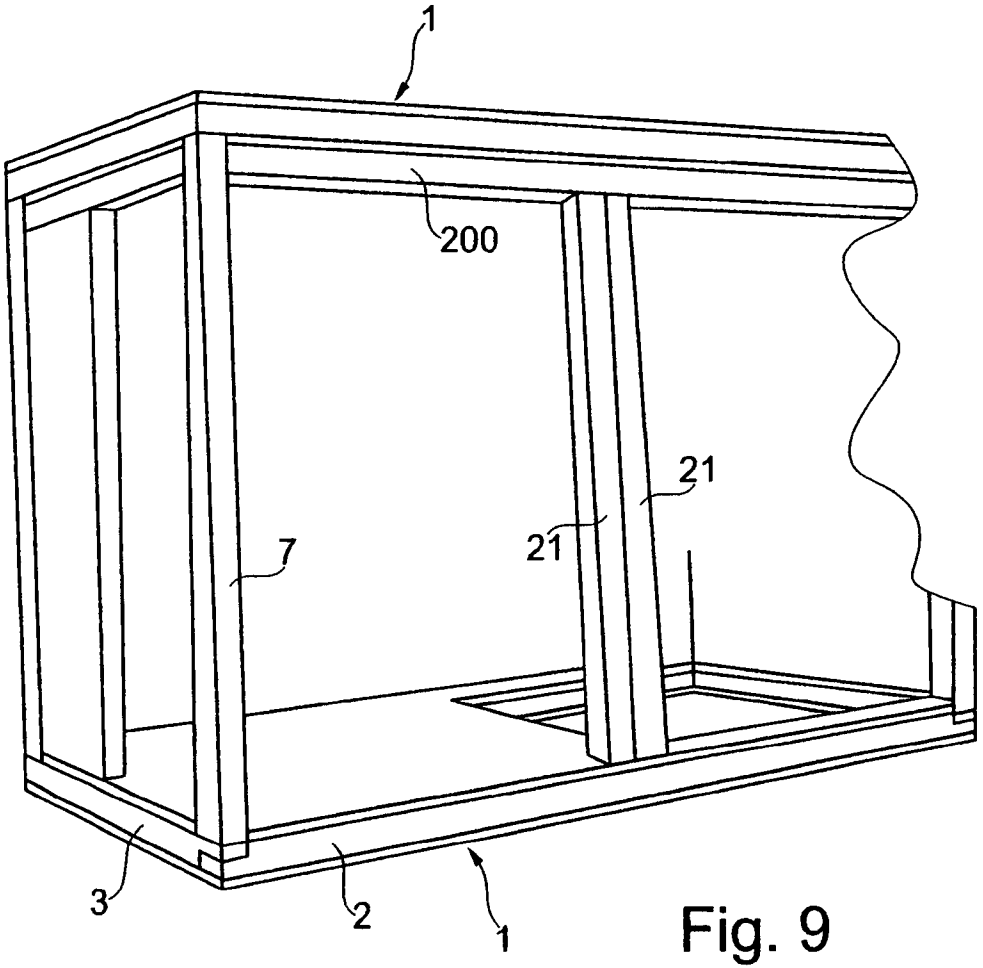
Figure 10:
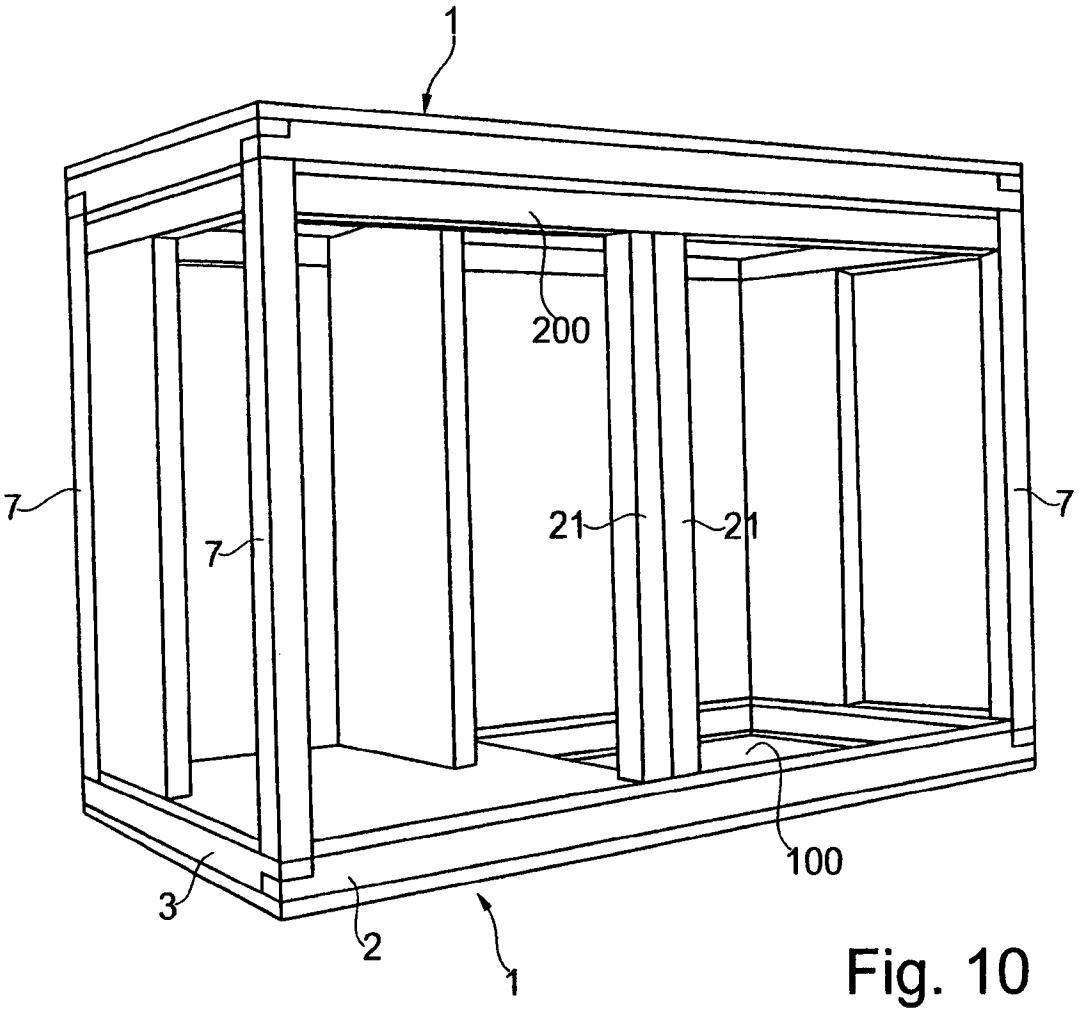
Figure 11:
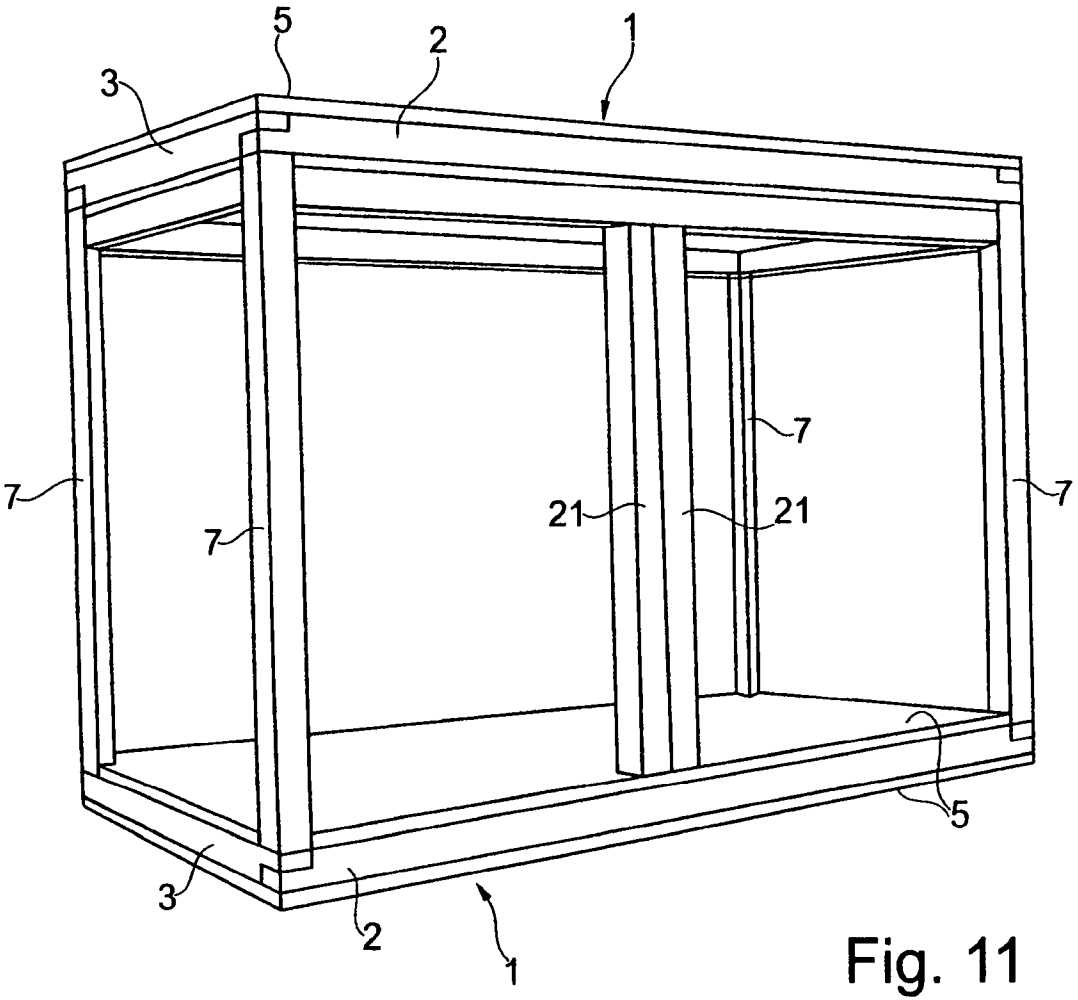

FIG. 1 shows a perspective view of a floor or ceiling slab, wherein the upper cladding is partially removed, FIG. 2 shows a perspective view of a room module formed by a floor and a ceiling slab and corner posts arranged in between, FIG. 3 shows a view of a wall element which can be inserted between the floor and ceiling slab of a room module, FIG. 4 shows the use of floor or ceiling slabs for producing walls, FIG. 5 shows prestressable beam arrangements, FIGS. 6 to 8 show beam and support structures which can be produced from elements of the construction system, and FIGS. 9 to 11 show different room modules with horizontal beams arranged below the ceiling slab.

DETAILED DESCRIPTION OF PREFERRED EMBODIMENTS

According to FIG. 1, a floor or ceiling slab 1 according to the invention has at its edge a peripheral frame which is formed by marginal longitudinal and transverse beams 2 and 3, which preferably consist of quarter timbers, with the result that the beams remain free from warping. The beams are overlapped with one another and pinned at the frame corners.

Between the marginal transverse beams 3 are provided further transverse beams 4, via which the longitudinal beams 2 are connected to one another in the manner of a ladder structure. The upper and lower side of the frame formed by the beams 2 to 4 is clad with squared timbers 5 extending in the frame longitudinal direction, which timbers are cut out at the frame corners to form cutouts 6 which are square in plan view. The frame cells formed between the transverse beams 3 and 4 and situated between the upper and lower cladding can be filled with in principle any desired insulating materials or the like. Preferably, the clearance between the squared timbers 5 forming the upper cladding and the lower cladding are filled with mineral wool or some other noncombustible insulating material.

Preferably, the claddings are designed as panels in that the squared timbers forming the claddings are pinned to one another, in particular by means of self-cutting screws, wherein the pins are in each case arranged parallel to the cladding plane and perpendicular to the longitudinal axes of the squared timbers. Panels which are identical in principle are also provided for the wall elements described further below.

The cutouts 6 in the claddings at the frame corners are intended for the positive accommodation of posts or supports 7 with corresponding cross section, wherein the posts 7 are connected in a tension- and shear-resistant manner to the frame corners exposed at the cutouts by means of dowels or threaded rods. Here, the cutouts 6 serve on the one hand to positively surround the posts and on the other hand, on the side of the frame corner remote from the post, to ensure sufficient accommodation space for dowel parts projecting from the frame corners, which dowel parts can be readily gripped with corresponding tools at the frame corners.

The posts are preferably traversed by an axial channel in which a threaded rod protruding at both ends of the post or a tensioning cable with threaded parts forming its ends is arranged. The projecting ends of the threaded rod or threaded parts traverse corresponding holes at the corners of the frame corners formed by the beams 2 and 3, in which case nuts or internal threaded parts are screwed on the frame side remote from the respective post and are clamped against the frames with the interposition of annular disks. Thus, the posts form a very stable three-dimensional lattice with the frames. The nuts or internal threaded parts can be designed as carrying eyes on which the room modules formed by a respective floor slab and ceiling slab and the corner posts can be coupled with a crane and transferred on a construction site.

The posts can be composed of two squared timbers each forming half the cross section of the post and are pinned to one another, in particular with self-cutting screws. To form the axial channel, a central axial groove is in each case arranged on the mutually facing contact surfaces of the squared timbers.

According to FIG. 2, in each case one floor slab and one ceiling slab 1 with the posts 7 arranged in between at the corners form a room module, which can be arranged virtually as desired on a corresponding base or on other room modules, it being possible to achieve very different ground plans. If here the room modules abut one another with their longitudinal sides, comparatively large support-free rooms can be produced.

In principle, however, it is also possible to produce support-free rooms of virtually any desired size with the floor or ceiling slabs. For this purpose, the floor or ceiling slabs can be hooked by their longitudinal or transverse edges into the lateral recesses between the upper flange and lower flange of double-T girders arranged in a cantilevered manner. In this case, profiled beams are preferably arranged on the marginal longitudinal or transverse beams of the floor or ceiling slabs, the width of which profiled beams corresponds to the horizontal depth of the recesses between the upper and lower flange of the double-T girders. In this way it is possible to achieve a situation in which the horizontal spacing between the double-T girders can correspond to the length or width of the floor or ceiling slabs. Preferably, use is made of such double-T girders in which the vertical spacing between the upper and lower flange corresponds to twice the vertical thickness of the ceiling or floor slabs or of the profiled beams arranged thereon. Thus, each double-T girder can, on the one hand, marginally retain the ceiling slab of a lower story and, on the other hand, the floor slab of a story situated above.

As has already been mentioned above, wall elements can be arranged in virtually any desired manner to divide the room between the floor and ceiling slabs of a room module. Here, prefabricated standard wall elements 20 are preferably dimensioned such that, when arranged at the narrow side of a room module between the corner-side posts of the room module, they close in each case half the opening width between the corner posts, i.e. in each case two standard wall elements are sufficient to close the entire narrow side of a room module.

In an advantageous optimization of the dimensions, the lengths of the room modules are dimensioned such that the measurements of length and width are 2:1. The openings between the corner posts on the longitudinal sides of the room modules can in each case be closed by means of two additional posts 21 which can be inserted between the floor and ceiling slab of the room module and a total of four aforementioned standard wall elements. It is provided here that the additional posts have the same cross sections as the corner posts. Furthermore, the additional posts 21 have a height such that they fit between the claddings 5 of the floor and ceiling slabs 1. Instead of the wall elements, correspondingly dimensioned door or window elements can also be arranged or be exchanged for the wall elements.

The wall elements substantially consist of two panels each composed of squared timbers, between which panels spacer elements are arranged. To construct the panels, use is preferably made of squared timbers having a thickness of 40 mm and a width of 80 mm. According to FIG. 3, the vertically arranged squared timbers 8 are butt-jointed against one another by their narrow (40 mm wide) vertical sides in that adjacent squared timbers 8 are connected to one another by pins 9, in particular self-cutting screws, which are arranged horizontally and parallel to the panel plane.

Spacer elements 10 which extend obliquely to the horizontal are arranged between the wall panels formed by the squared timbers 8, the thickness of which spacer elements corresponds to the thickness of the squared timbers 8 and is for example 40 mm. These spacer elements are in turn pinned to the squared timbers 8 forming the panels, preferably by self-cutting screws, and in this case the pins are arranged perpendicularly to the panel plane. Furthermore, squared timbers 11 arranged in the manner of a peripheral frame are provided between the panels formed by the squared timbers 8 and can have for example a square cross section with a width and thickness of in each case 40 mm. These squared timbers 11 are arranged with a spacing from the edge of the panels formed by the squared timbers 8, with the result that a peripheral groove is formed between the edges of the two panels forming the respective wall element, into which grooves correspondingly dimensioned squared timber profiles can be inserted in the manner of tongues. These tongues can serve on the one hand for connecting mutually adjoining wall elements and on the other hand for the positive retention of the wall elements on the floor or ceiling slabs of the room modules.

To increase the thermal insulation and/or thermal capacity of the wall element, the cavities between the wall panels of a wall element can be filled with a bulk material, in particular with limestone chips. This also improves the soundproofing of the wall elements.

The invention is not limited to the exemplary embodiments illustrated above.

In the preceding embodiments, it is assumed that the intermediate posts 21 are shortened in comparison to the corner posts 7 in such a way that the intermediate posts 21 fit between the mutually facing claddings 5 of the floor or ceiling slabs 1 of the respective room module. Instead, it is also possible to form the intermediate posts 21 identically to the corner posts 7 and for this purpose to provide further cutouts 60, analogous to the cutouts 6 at the corners of the floor or ceiling slabs 1, in the claddings 5 at the longitudinal beams 2 of the respective floor or ceiling slab 1. In particular, for this purpose, cutouts 60 can be provided in each case at the longitudinal center of each floor or ceiling slab at the longitudinal edges in the region of the longitudinal beams 2, which cutouts are dimensioned in such a way that they can accommodate two posts which are directly adjacent in the longitudinal direction of the floor or ceiling slab 1.

However, in principle, another arrangement of the posts 21 between the corners of the respective room module is also possible.

According to FIGS. 9 to 11, it can be, advantageously provided to form outer or inner walls arranged on or in a room module or else intermediate posts with a height reduced with respect to the vertical space in between the floor and ceiling slab and to close off the remaining clearance by means of a horizontal beam 200 with a cross section which fits with respect to the vertical spacing and the wall thickness. This simplifies the arrangement of the walls. In addition, a door or window lintel which facilitates the installation of doors or windows is formed in this way.

The final mounting of the room modules can take place readily at the respective construction site, with the result that the floor or ceiling slabs 1 can be delivered stacked during transportation with customary trucks without an excessive volume requirement. At the construction site, the corner posts 7 and the intermediate posts 21 optionally provided as additional connections between the floor slab and the ceiling slab are then arranged at the corner-side or longitudinal-side cutouts 6, 60 of the floor-side cladding 5 of the floor slab in that the threaded parts of the threaded rods or tension cables or the like projecting from the posts are inserted into holes in the frame beams of the floor slab. The ceiling slab is then placed on top and braced with the floor slab via the posts in that the aforementioned internal threaded parts are screwed on and firmly clamped to the threaded segments of the threaded rods or tensioning cables.

If appropriate, outer or intermediate walls can then also be arranged. Then, the finished construction module can be lifted by a crane and be deposited on already erected building parts.

FIGS. 9 and 10 furthermore show by way of example that the floor or ceiling slabs 1 can, if appropriate, be provided with openings 100 for staircases or the like to be installed later. Moreover, outer or intermediate walls can be arranged at any time after completion of a "skeleton structure" formed from the room modules.

Furthermore, the floor or ceiling slabs 1 and the posts 7 or 21 can also serve for the production of multistory room modules. Here, only a single ceiling or floor slab is generally provided between stories of the room module which lie directly above one another. Insofar as the posts arranged in adjacent stories of the multistory room module continue one another coaxially, as is the case particularly with the corner posts, these posts can be traversed by a single common threaded rod whose ends then project at the corners of the uppermost ceiling slab or lowermost floor slab, with the result that it is possible there, in a fundamentally identical manner as has been described above for a single-story room module, to clamp nuts or internal threaded parts against the frames of the respective floor or ceiling slab with the interposition of annular disks.

Instead of the threaded rods, tension cables can also be provided in the case of single-story and also multistory room modules, the ends of which cables adjoin threaded parts onto which the aforementioned nuts or internal threaded parts can then be screwed for tensioning with the interposition of the stated annular disks.

The floor or ceiling slabs can if required also be used as wall slabs which can be inserted in a load-bearing manner, it being possible according to FIG. 4 for a plurality of floor or ceiling slabs 1 to be assembled to form a large wall slab. As FIG. 4 shows, flange plates 61 and 62 or 61' and 62' can be arranged for this purpose in mutually adjoining cutouts 6 or 60 of the claddings 5 of the slabs 1 which are to be connected flat to one another, on one side or on both sides of said slabs, which flange plates are then connected to one another by means of screws or the like traversing the longitudinal beams 2 of the adjacent or of the respective slabs 1. The possibility exists, in this way, of producing large-area walls with low manufacturing outlay.

If required, the posts can also be used as beams, in which case a plurality of posts or beams arranged lying vertically above one another can form a highly loadable carrier whose individual beams can be pretensioned in a different way by means of the threaded rods or tensioning cables. FIG. 5 shows an example of such an arrangement.

Here, FIG. 5 also shows that the posts or beams 7 can in each case be composed of two squared timbers with a rectangular cross section. The squared timbers are connected to one another without glue, preferably by means of pinning using self-cutting screws. On their mutually facing wide side faces, the squared timbers each have a longitudinal groove, wherein the two longitudinal grooves of the two squared timbers together form a longitudinal channel for accommodating the aforementioned threaded rod or the tensioning cable provided instead. In principle, the posts or beams formed by the squared timbers can be joined axially to one another multiple times, with the result that virtually any extra-long posts or beams 7 can be produced which are in each case composed of short post or beam segments which axially continue one another. Here, these segments can engage in one another positively by means of diametrically opposed wedge joints arranged at their end faces, wherein the positive connection is ensured without glue or adhesive by bracing the respectively traversing threaded rod or the tensioning cable.

FIGS. 6 to 8 show different possibilities of producing different beam or post structures or wall or ceiling structures using the squared timbers used in FIG. 5 for the beams or posts illustrated therein. FIG. 6 shows a beam which is composed of squared timbers 70 arranged in multiple layers, wherein the squared timbers 70 of the respective next layer are arranged offset relative to the preceding layer by half a squared timber length. Adjacent layers of the squared timbers 70 are in each case connected glue-free by pinning using self-cutting screws.

FIG. 7 shows the possibility that the layers of the squared timbers can if appropriate also be arranged offset relative to one another in the transverse direction. This makes it possible to achieve an increased stiffness against bending stresses with respect to an axis perpendicular to the large side faces of the squared timbers 70.

FIG. 8 shows quite generally the possibility of assembling structural parts with large cross sections from squared timbers 70 connected to one another without glue, in particular by pinning using self-cutting screws. Here, mutually adjacent squared timbers are each arranged offset to one another in the longitudinal direction, and it is preferably provided for adjacent squared timber layers also to be arranged offset to one another in the transverse direction of the squared timbers. As a result of the pinning shown in FIG. 8 in two directions which are substantially perpendicular to one another, that is to say on the one hand a pinning perpendicular to the narrow side faces of the squared timbers and on the other hand a pinning perpendicular to the wide side faces of the squared timbers, an extremely loadable assembly is achieved. As a result, solid wall, ceiling, post or carrier structures can thus be produced.

As a departure from the representation in FIG. 8 in which the squared timbers 70 are each arranged with longitudinal axes parallel to one another, the squared timbers can also be arranged in the form of crosslayers pinned to one another.

The invention claimed is:

1. A modular construction system for structures, comprising room-sized modules adapted to be stacked one on top of another to form a building construction and being formed from prefabricated rectangular wooden floor and ceiling slabs (1) and wooden supports or posts (7) which are arranged or can be mounted at the slab corners between a respective floor and ceiling slabs, said slabs comprising a wooden frame with marginal longitudinal and marginal transverse beams forming slab edges and slab corners and forming a rectangle, and further or inner transverse beams arranged as ladder rungs between the marginal transverse beams, said frame being clad with upper and lower wooden claddings consisting of planks which are composed of squared timbers arranged on upper and lower sides of the frame, said planking being cut out at the slab corners corresponding to a cross section of the support posts, which are directly connected or pinned to a top side or lower side of the respective corners of the frames, wherein the longitudinal or transverse edges of the floor or ceiling slabs are hooked into lateral recesses of cantilevered double-T girders.

2. The construction system as claimed in claim 1, wherein the floor slab of a relative upper room module is arranged on the ceiling slab or the ceiling slabs of a relative lower room module or a plurality of lower room modules.

3. The construction system as claimed in claim 1, wherein cavities between the claddings (5) are filled or can be filled with insulating materials.

4. The construction system as claimed in claim 1, wherein marginal transverse and longitudinal beams (2, 3) are overlapped with one another at the frame corners and are connected by pinning.

5. The construction system as claimed in claim 1, wherein the remaining transverse beams are pinned with the marginal longitudinal beams via fittings.

6. The construction system as claimed in claim 1, wherein the posts or supports (7) are connected to the wooden frame of the adjoining slabs by means of threaded rods which pass through an axial channel of the post or the support and through holes at the frame corners, the threaded rods having free ends on which threaded parts clamped against the frame corners are screwed.

7. The construction system as claimed in claim 1, wherein open sides of the room modules between the corner posts are closed by standardized wall or window modules (20).

8. The construction system as claimed in claim 7, wherein the wall or window modules are dimensioned in such a way that the openings between the corner posts (7) at narrow sides of the room modules are closed by in each case two wall or window modules (20) and the openings at the longitudinal sides of the room modules can be closed by four wall or window modules (20) and two standardized additional supports or posts.

9. The construction system as claimed in claim 1, wherein the floor and ceiling slabs have a length/width ratio of 2:1.

10. The construction system as claimed in claim 8, wherein the additional supports or posts (21) have cross sections identical to the corner posts (7).

11. The construction system as claimed in claim 1, wherein elements forming the wooden frame are designed as adhesive-free wooden constructions.

12. The construction system as claimed in claim 1, wherein floor or ceiling slabs (1) are arranged as parts of walls or supporting walls.

13. The construction system as claimed in claim 1, wherein the supports or posts (7, 21) are composed of timbers, which fill the post cross section while leaving free a central longitudinal channel, and a tension member is arranged in the longitudinal channel.

14. The construction system as claimed in claim 13, wherein the supports or posts (7, 21) are composed of two squared timbers with a rectangular cross section and the longitudinal channel is formed by central longitudinal grooves on mutually facing lateral surfaces of the squared timbers.

15. The construction system as claimed in claim 1, wherein elements provided as beam supports, posts and/or wall, ceiling and/or roof systems are composed of squared timbers (70) which overlap one another in the longitudinal and/or transverse direction.

16. The construction system as claimed in claim 15, wherein the squared timbers (70) are pinned to one another, in particular by means of self-cutting screws.

17. The construction system according to claim 16, wherein the self-cutting screws are arranged parallel to a cladding plane and perpendicular to longitudinal axes of the squared timbers.

18. The construction system according to claim 1, where in all of the wood elements are designed as adhesive-free wood structures.

19. The construction system according to claim 17, wherein the squared timbers are joined together without glue.

20. The construction system according to claim 1, wherein the marginal longitudinal or transverse beams of the floor or ceiling slabs are provided with profile beams having a width corresponding to a horizontal depth of the recesses between the top and bottom chord of the double-T girder, so that a horizontal distance between the double-T girders corresponds to a length or width of the floor or ceiling slabs.

21. The construction system according to claim 13, wherein the wooden supports or posts uniaxially continue in adjacent floors of a multistory building and are traversed by a single threaded rod or a single tensioning rope, ends of which have threaded pieces that project out at corners of the uppermost ceiling or lower most floor slab, so that nuts or internal threaded parts can be clamped against the frames of the respective floor or ceiling slab, with interspersion of eyebolts.

* * * * *